US009463965B2

(12) United States Patent
Heravi et al.

(10) Patent No.: US 9,463,965 B2
(45) Date of Patent: Oct. 11, 2016

(54) PULLING TOOL

(71) Applicant: Warn Industries, Inc., Clackamas, OR (US)

(72) Inventors: Oliver Heravi, Tigard, OR (US); Randy C. Karambelas, Milwaukie, OR (US); Steven W. Shuyler, Clackamas, OR (US); Robert W. Logston, Duluth, GA (US); Darren G. Fretz, Canby, OR (US); Richard L. Rickert, Sandy, OR (US); Bryan Yoder, Corvallis, OR (US); Nicholas E. Juenemann, North Plains, OR (US)

(73) Assignee: Warn Industries, Inc., Clackamas, OR (US)

( * ) Notice: Subject to any disclaimer, the term of this patent is extended or adjusted under 35 U.S.C. 154(b) by 184 days.

(21) Appl. No.: 13/800,884

(22) Filed: Mar. 13, 2013

(65) Prior Publication Data

US 2014/0264210 A1 Sep. 18, 2014

(51) Int. Cl.

| | |
|---|---|
| ***B66D 3/20*** | (2006.01) |
| ***B66D 1/12*** | (2006.01) |
| ***B66D 1/46*** | (2006.01) |
| *B66D 1/48* | (2006.01) |

(52) U.S. Cl.

CPC . *B66D 3/20* (2013.01); *B66D 1/12* (2013.01); *B66D 1/46* (2013.01); *B66D 1/48* (2013.01)

(58) Field of Classification Search

USPC ..... 254/344, 359, 266, 213, 219, 342, 362

See application file for complete search history.

(56) References Cited

U.S. PATENT DOCUMENTS

| | | | | |
|---|---|---|---|---|
| 2,180,354 A * | 11/1939 | Frazier | G01C 13/004 242/375.1 |
| 2,255,574 A * | 9/1941 | Waseige | 254/267 |
| 2,435,353 A * | 2/1948 | Hite | 254/339 |
| 2,443,763 A * | 6/1948 | Dahlgren et al. | 242/390.2 |

(Continued)

FOREIGN PATENT DOCUMENTS

| | | |
|---|---|---|
| EP | 0515185 A1 | 11/1992 |
| GB | 2013375 A | 8/1979 |

(Continued)

OTHER PUBLICATIONS

ISA United States Patent and Trademark Office, International Search Report and Written Opinion of PCT/US14/11203, May 12, 2014, 21 pages.

(Continued)

*Primary Examiner* — Emmanuel M Marcelo
*Assistant Examiner* — Justin Stefanon
(74) *Attorney, Agent, or Firm* — Alleman Hall McCoy Russell & Tuttle LLP

(57) ABSTRACT

A pulling tool is provided with a rotatable drum having a cable wound thereon. A motor is drivingly connected to the rotatable drum and the rotatable drum and motor are disposed within a unique housing structure. The rotatable drum is driven by a planetary gear system that is disposed within the rotatable drum to provide a compact assembly. A belt and pulley system is provided for delivering torque from the motor to the planetary gear system. The rotatable drum is provided with a two-piece stepped construction that allows the planetary gear system to be assembled within the drum and allows for the initial wraps of a cable around the smaller diameter portion of the stepped drum.

23 Claims, 14 Drawing Sheets

(56) References Cited

U.S. PATENT DOCUMENTS

| | | | | | |
|---|---|---|---|---|---|
| 2,545,892 | A * | 3/1951 | Moore | 254/344 | |
| 2,546,863 | A * | 3/1951 | Moore | 254/344 | |
| 2,891,767 | A * | 6/1959 | Armington, Jr. | 254/344 | |
| 3,265,362 | A | 8/1966 | Moody | | |
| 3,309,066 | A * | 3/1967 | Carlson et al. | 254/268 | |
| 3,648,977 | A | 3/1972 | Rohrer et al. | | |
| 3,929,555 | A | 12/1975 | Sanders | | |
| D238,861 | S | 2/1976 | Cavalleri | | |
| 4,014,224 | A | 3/1977 | Pitts | | |
| 4,033,552 | A | 7/1977 | Kuzarov | | |
| 4,123,040 | A | 10/1978 | Kuzarov | | |
| 4,196,889 | A * | 4/1980 | Dudek | 254/344 | |
| 4,328,954 | A * | 5/1982 | Logus | 254/344 | |
| 4,392,635 | A * | 7/1983 | Muessel et al. | 254/344 | |
| 4,430,909 | A * | 2/1984 | Magnuson | 475/330 | |
| 4,565,352 | A * | 1/1986 | Hasselmann et al. | 254/344 | |
| 4,623,124 | A * | 11/1986 | Lewis | B66D 1/08 | 254/350 |
| 4,736,929 | A | 4/1988 | McMorris | | |
| 4,884,784 | A | 12/1989 | Nix et al. | | |
| 5,184,807 | A * | 2/1993 | Nikolov et al. | 254/344 | |
| 5,195,726 | A | 3/1993 | Kaner | | |
| 5,214,359 | A | 5/1993 | Herndon et al. | | |
| 5,284,325 | A | 2/1994 | Sasaki et al. | | |
| 5,386,970 | A | 2/1995 | Trant | | |
| D364,027 | S | 11/1995 | Hung | | |
| 5,474,278 | A * | 12/1995 | Cleveland | B66D 1/00 | 224/153 |
| 5,522,582 | A * | 6/1996 | Dilks | 254/323 | |
| 5,607,143 | A | 3/1997 | Regal | | |
| 5,622,058 | A | 4/1997 | Ramakrishnan et al. | | |
| 5,702,320 | A * | 12/1997 | Brassai et al. | 475/159 | |
| 5,738,340 | A | 4/1998 | Brantner | | |
| 5,863,028 | A | 1/1999 | Dunsmore | | |
| 5,909,783 | A | 6/1999 | Berish | | |
| 5,996,971 | A | 12/1999 | Crouse et al. | | |
| 6,179,270 | B1 | 1/2001 | Higdon | | |
| D438,358 | S | 2/2001 | Huang | | |
| D439,722 | S | 3/2001 | Huang | | |
| 6,218,746 | B1 | 4/2001 | Gouge, Jr. | | |
| 6,241,215 | B1 * | 6/2001 | Gersemsky | A61G 7/1015 | 254/342 |
| 6,286,786 | B1 | 9/2001 | Le Gette et al. | | |
| 6,309,168 | B1 | 10/2001 | Holmes | | |
| 6,386,513 | B1 | 5/2002 | Kazerooni | | |
| 6,435,768 | B1 | 8/2002 | Mansfield | | |
| D473,992 | S | 4/2003 | Hodge | | |
| 6,637,610 | B1 | 10/2003 | Cheeseboro | | |
| 6,682,050 | B1 | 1/2004 | Ray | | |
| D489,157 | S | 4/2004 | Lawson | | |
| 7,021,427 | B2 * | 4/2006 | Skovgaard | A61G 7/1015 | 187/281 |
| D524,508 | S | 7/2006 | Lichtenvort | | |
| 7,227,322 | B2 * | 6/2007 | Alipour et al. | 318/281 | |
| D556,420 | S | 11/2007 | Trihey et al. | | |
| D571,973 | S | 6/2008 | Burns et al. | | |
| D573,775 | S | 7/2008 | Burns et al. | | |
| 7,784,768 | B2 | 8/2010 | LaFreniere | | |
| 7,850,145 | B2 | 12/2010 | Heravi et al. | | |
| 8,056,884 | B2 | 11/2011 | LaFreniere | | |
| 8,079,569 | B2 * | 12/2011 | Lesko | 254/344 | |
| 8,176,593 | B2 * | 5/2012 | Gress | B08B 9/045 | 15/104.33 |
| 8,820,718 | B2 | 9/2014 | Weidner | | |
| 8,991,788 | B2 * | 3/2015 | Mueller | B63B 27/143 | 114/259 |
| 2001/0023905 | A1 | 9/2001 | Kigawa et al. | | |
| 2001/0040233 | A1 | 11/2001 | Chamberlain | | |
| 2002/0104918 | A1 | 8/2002 | Zacharias | | |
| 2003/0111654 | A1 * | 6/2003 | Huang | 254/344 | |
| 2003/0151037 | A1 * | 8/2003 | O'Fallon | 254/344 | |
| 2004/0194361 | A1 | 10/2004 | Furlan et al. | | |
| 2006/0142945 | A1 | 6/2006 | McLaughlin | | |
| 2008/0224110 | A1 * | 9/2008 | Starks | B66D 3/20 | 254/264 |
| 2008/0246011 | A1 | 10/2008 | Heravi et al. | | |
| 2008/0267009 | A1 * | 10/2008 | Frivik et al. | 367/15 | |
| 2009/0071671 | A1 | 3/2009 | Zhong et al. | | |
| 2009/0100688 | A1 | 4/2009 | Sugishita | | |
| 2009/0256125 | A1 * | 10/2009 | Graner et al. | 254/342 | |
| 2011/0180770 | A1 * | 7/2011 | Karambelas et al. | 254/344 | |
| 2011/0215285 | A1 | 9/2011 | Akhavein et al. | | |
| 2011/0303886 | A1 * | 12/2011 | Cryer et al. | 254/340 | |
| 2012/0061633 | A1 | 3/2012 | Holley | | |
| 2012/0223042 | A1 * | 9/2012 | McNiff | 212/295 | |
| 2012/0275893 | A1 * | 11/2012 | Colwell | E02F 3/46 | 414/685 |
| 2013/0056694 | A1 | 3/2013 | Wilkins et al. | | |
| 2013/0259621 | A1 * | 10/2013 | Wurster et al. | 414/685 | |
| 2014/0239871 | A1 * | 8/2014 | Savva | B63B 21/16 | 318/504 |

FOREIGN PATENT DOCUMENTS

| | | | |
|---|---|---|---|
| JP | 6083458 | A | 3/1994 |
| JP | 2003-252573 | A | 9/2003 |

OTHER PUBLICATIONS

ISA United States and Patent Office, International Search Report and Written Opinion of PCT/US14/11207, May 7, 2014, 18 pages.

* cited by examiner

PULLING TOOL

FIELD

The present disclosure relates to a pulling device, and more particularly, to a portable pulling tool that is provided with a durable compact construction and reliable gear train and motor control system therefore.

BACKGROUND

This section provides background information related to the present disclosure which is not necessarily prior art.

Winches and hoists are used for a wide range of applications and many different sizes and types of winches and hoists are produced. Winches are commonly mounted to bumpers of off-road vehicles and can be utilized to pull a vehicle from a stuck condition, or to pull the vehicle up a steep incline, by attaching one end of the cable of the winch to a tree or other stationary object. The industrial winches and hoists are also utilized for lifting applications or on a job site, shop, barn, or home. Industrial winches and hoists are typically required to be bolted down or otherwise affixed to a stationary object for use and can sometimes be heavy in weight and cumbersome to carry.

The pulling tool of the present disclosure provides a portable, easy to carry, relatively lightweight compact construction for a pulling tool.

SUMMARY

This section provides a general summary of the disclosure, and is not a comprehensive disclosure of its full scope or all of its features.

According to an aspect of the present disclosure, a pulling tool is provided including a housing having a center shell defining a cavity therein and a pair of side openings. The center shell has a first end having a cable opening therein and a second end having an anchor portion. The housing includes a pair of end caps covering the pair of side openings. A rotatable drum is disposed in the housing and has a cable wound thereon. The cable extends through the cable opening in the first end of the center shell. A motor is disposed in the housing and is drivingly connected to the rotatable drum. The center shell has a generally oval cross-section and a pair of chassis members are disposed in the pair of side openings of the center shell for rotatably supporting the drum. A planetary gear train is provided for drivingly connecting the motor to the drum and the planetary gear train is disposed within the drum. The motor is connected to the planetary gear train by a drive pulley connected to the motor and a driven pulley connected to an input shaft of the planetary gear train and a drive belt is connected between the drive pulley and the driven pulley. The motor can be disposed between the drum and the cable opening at the first end of the center shall.

According to a further aspect of the present disclosure, the housing can include at least one cavity for receiving an accessory for the pulling tool.

According to a further aspect of the present disclosure, a magnet is disposed within the rotatable drum and a magnetic field sensor is provided for sensing when the cable is unwound from the drum in an area covering the magnet. A controller receives a signal from the magnetic field sensor and deactivates the motor when the magnetic field sensor senses the magnet in the drum when the cable is unwound from the drum to expose the magnetic field of the magnet.

According to a further aspect of the present disclosure, the rotatable drum can have a first cylindrical region having a first diameter and a second cylindrical region having a second diameter larger than the first diameter wherein the first cylindrical region receives initial wraps of the cable thereon. The magnet can be disposed within the drum in the smaller first cylindrical region of the drum. The rotatable drum can be made from a first drum half and a second drum half and can be secured together by a pair of drum flanges disposed at opposite ends of the drum. The two drum halves facilitate the assembly of the planetary gear train within the drum. The rotatable drum also includes a rope anchor recessed into a cylindrical face of the rotatable drum.

According to a further aspect of the present disclosure, an electric brake can be fixed within the housing and engage an input member of the planetary gear train to provide braking for the rotatable drum. The electric brake has a normally engaged condition and is electrically actuated to disengage the electric brake.

According to still another aspect of the present disclosure, the pulling tool is provided with an inclinometer that provides signals to a controller that controls operation of the pulling tool in a first mode when the inclinometer detects that the pulling tool is horizontally oriented and for controlling operation of the pulling tool in a second mode different than the first mode when the inclinometer detects that the pulling tool is vertically oriented.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
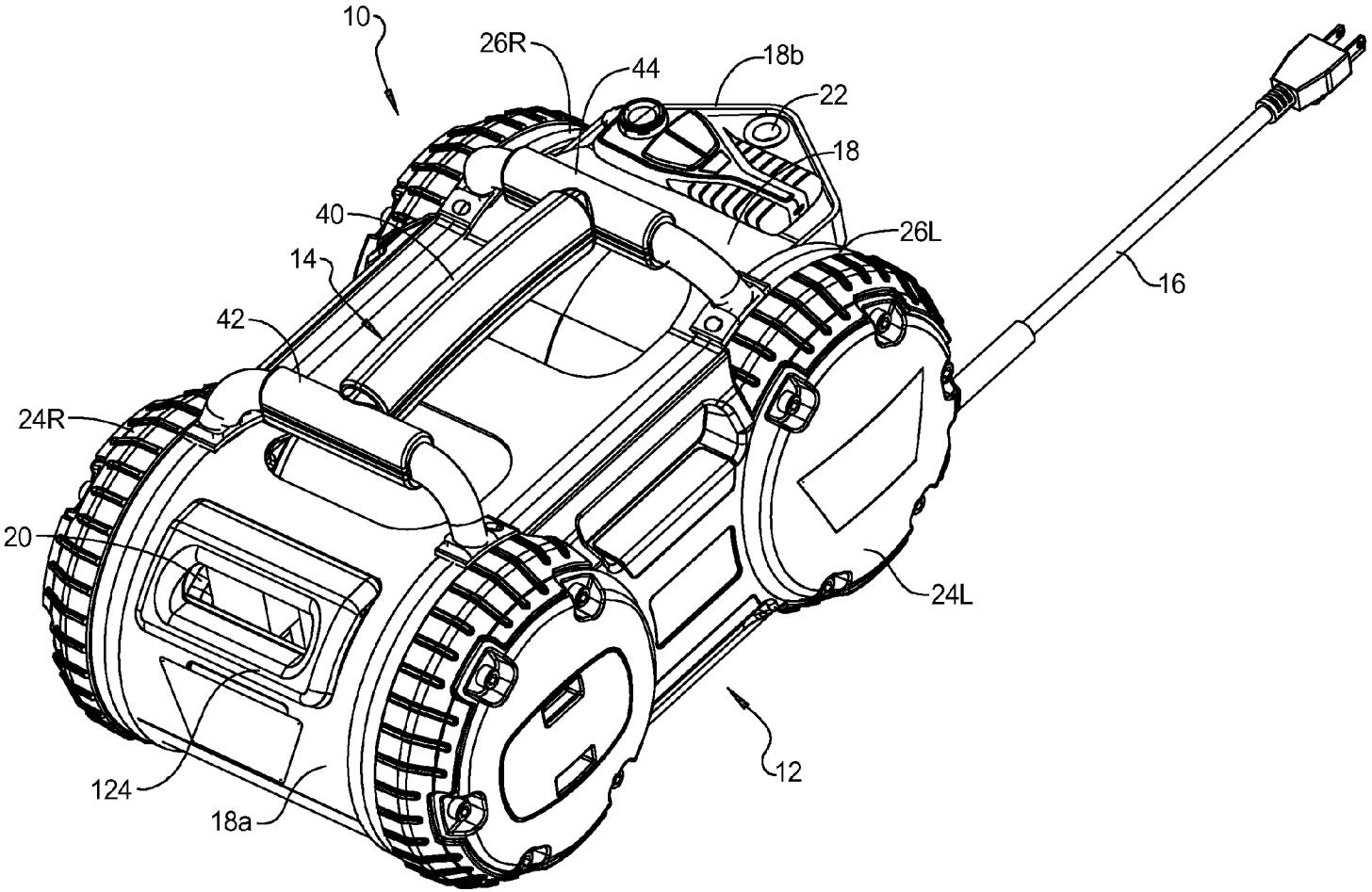
FIG. 1 is a perspective view of the portable pulling tool according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, the portable pulling tool 10 according to the principles of the present disclosure includes a housing 12, a handle 14 mounted to the housing 12, and a power cord 16 extending from the housing 12. The housing 12 includes a center shell 18 having a cable opening 20 in a first end 18*a* and an anchor portion 22 in a second end 18*b*. A pair of left and right side covers 24L, 24R are mounted to opposite sides of the center shell 18.

Figure 2:
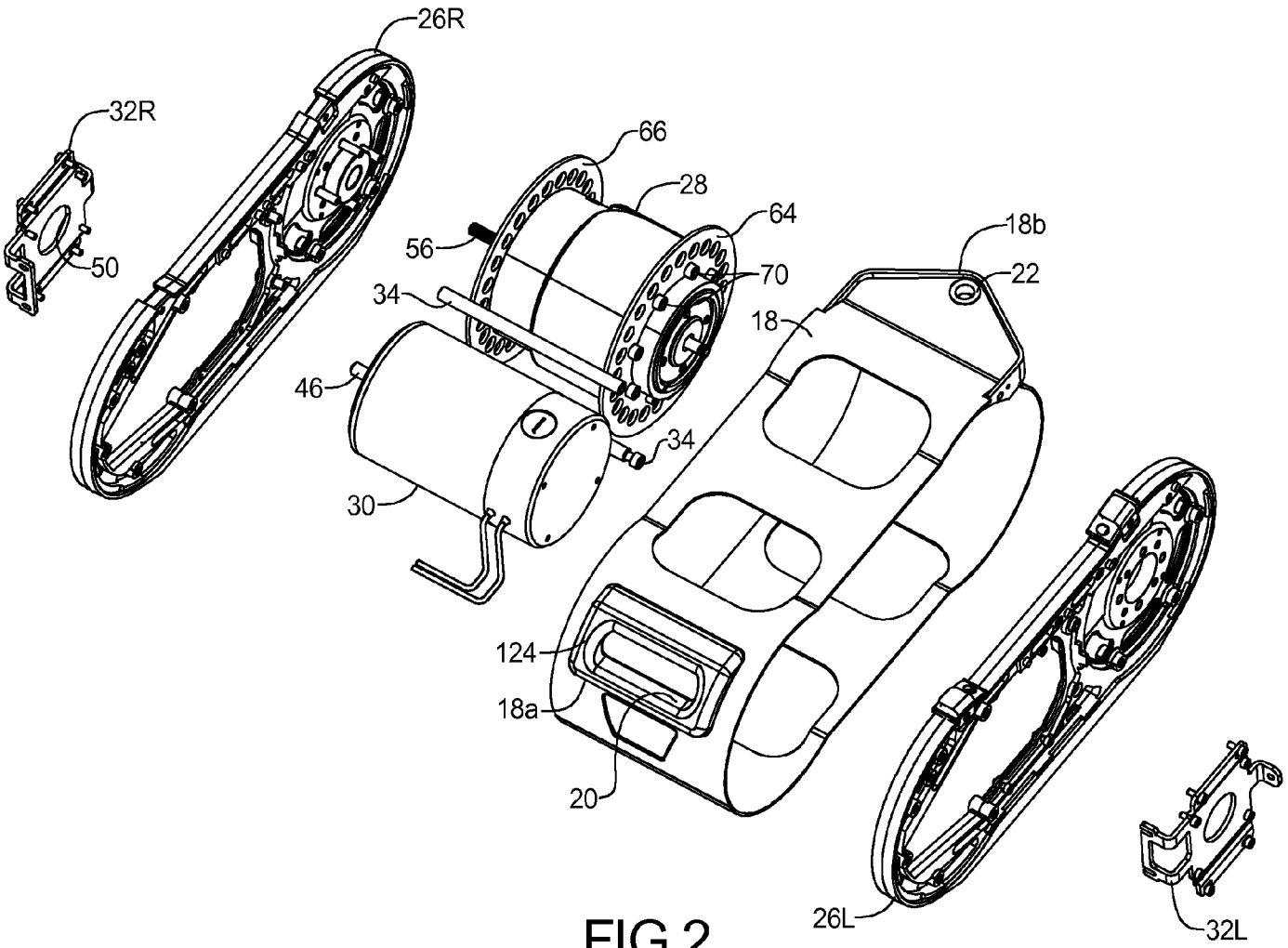
FIG. 2 is a perspective partially exploded view of components of the portable pulling tool for illustration purposes.

With reference to FIG. 2, the center shell 18 is shown and includes a generally oval shape in cross-section and includes two open sides on opposite sides thereof. A pair of side chassis members 26L, 26R are provided on the left and right sides of the shell 18, respectively. A rotatable drum 28 is rotatably supported by the side chassis members 26L, 26R within the center shell 18 of the housing 12. A motor 30 is mounted within the center shell 18 of the housing 12 between the side chassis members 26L, 26R. The motor 30 is supported by a pair of motor mount brackets 32L, 32R which are mounted to the side chassis members 26L, 26R, respectively. A pair of tie rods 34 are connected between the pair of side chassis members 26L, 26R and provide lateral support therebetween.

Figure 3:
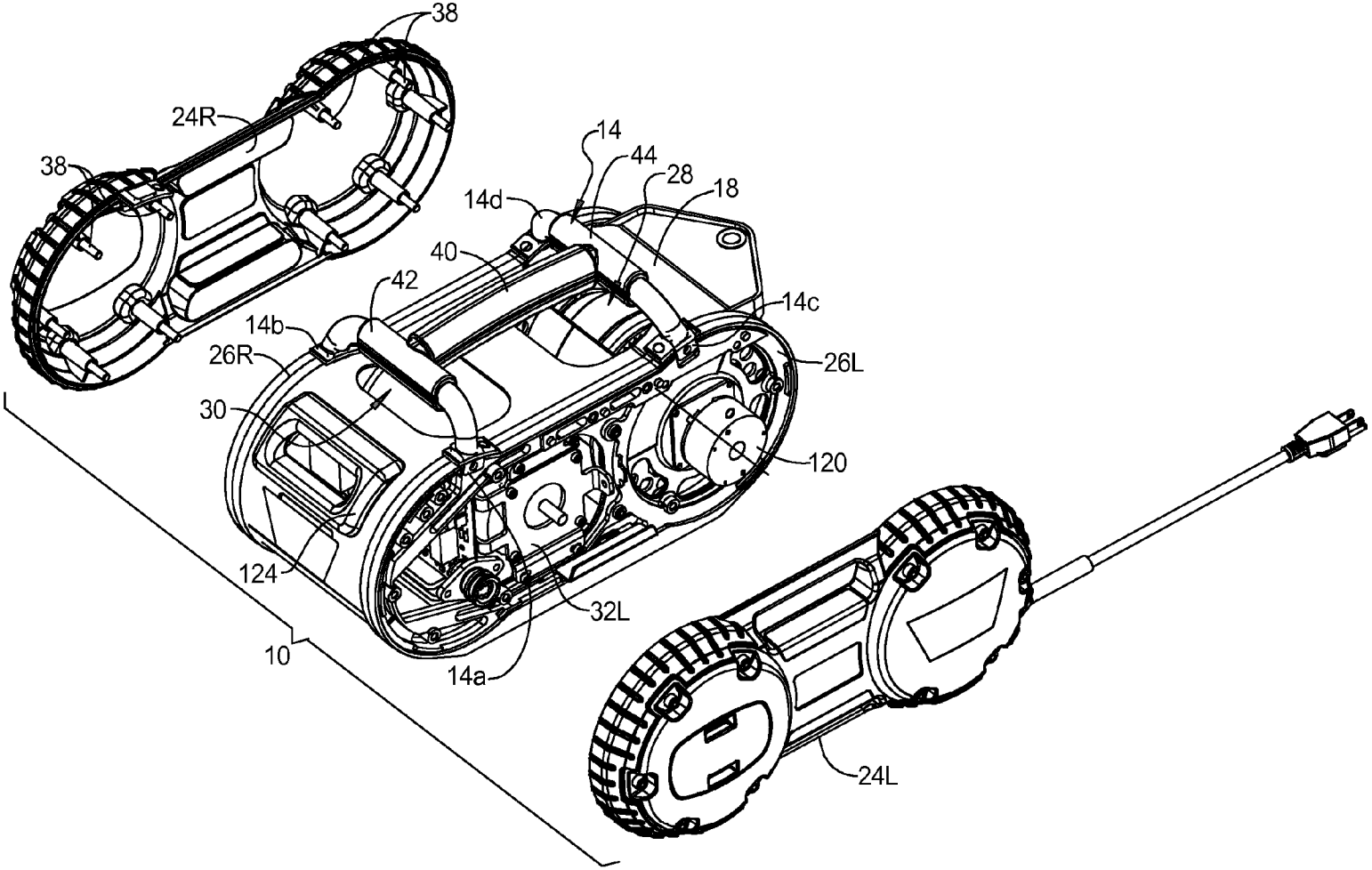
FIG. 3 is a partial exploded perspective view of the front of the portable pulling tool with the side covers removed for illustration purposes.
Figure 4:
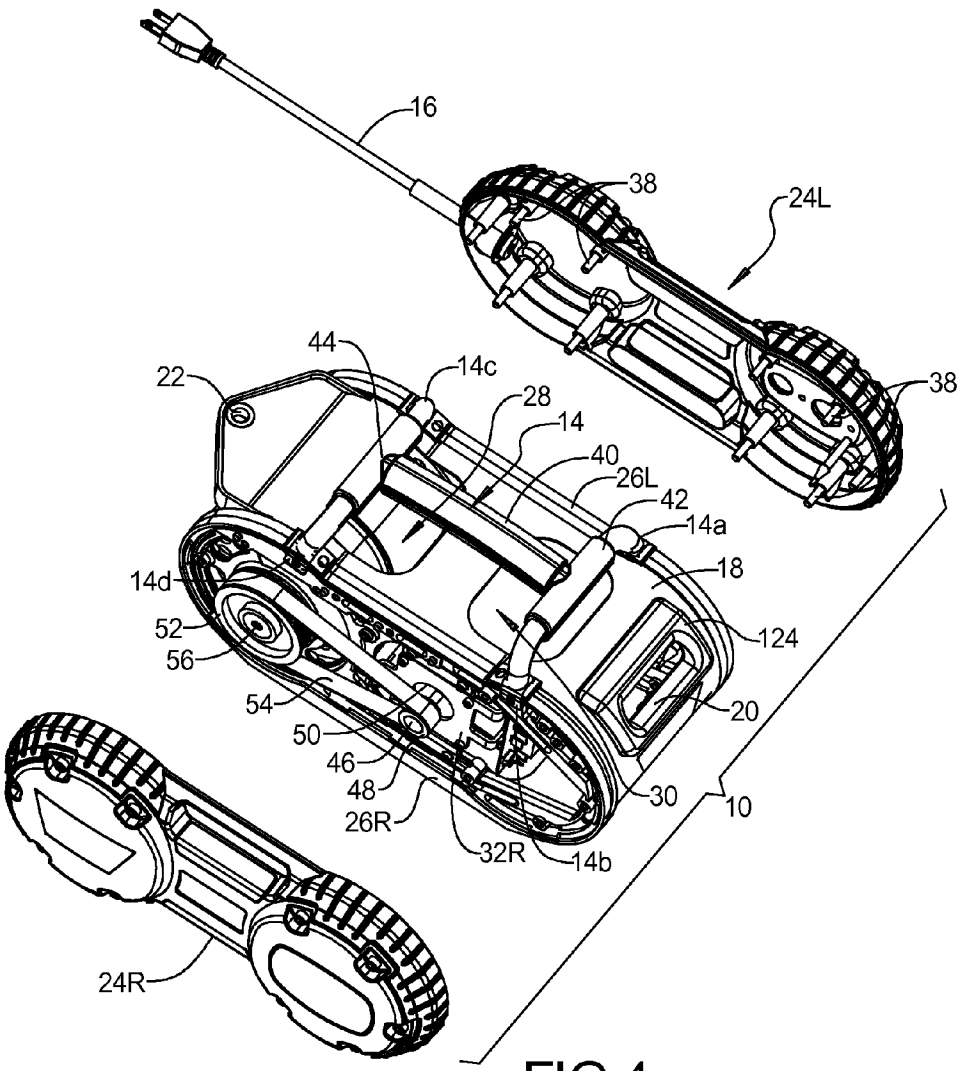
FIG. 4 is a partial exploded perspective view of the rear of the portable pulling tool with the side covers removed for illustration purposes.

With reference to FIG. 3, a front left perspective view of the portable pulling tool 10 is shown with the side covers 24L, 24R removed from the center shell 18 for illustrative purposes. The side chassis members 26L, 26R are disposed on opposite sides of the center shell 18 and the rotatable drum 28 is rotatably mounted between and supported by the side chassis members 26L, 26R. In addition, the motor mount bracket 32L is shown mounted to the side chassis member 26L for supporting the motor 30 within the center shell 18. The interior of the right side cover 24R is shown including mounting bosses 38 for securing the side cover 24R to the left and right side chassis members 26L, 26R. FIG. 4 is a similar view to FIG. 3 but from the opposite side of the pulling tool 10 and illustrates similar mounting bosses 38 on the inside of the left side cover 24L.

As illustrated in FIGS. 3 and 4, the handle 14 can include a pair of forward mounting locations 14*a*, 14*b* and a pair of rearward mounting locations 14*c*, 14*d* that connect the handle 14 to the left and right side chassis members 26L, 26R. The handle 14 also includes a center grip portion 40 and forward and rearward grip portions 42, 44 that allow the portable pulling tool 10 to be picked up and handled in various ways.

As illustrated in FIGS. 2 and 4, the motor 30 has a drive shaft 46 extending therefrom that is connected to a drive pulley 48. The drive shaft 46 and pulley 48 are disposed on an outboard side of the motor mount bracket 32R as well as the side chassis member 26R. The motor mount bracket 32R has an opening 50 therein for receiving the drive shaft 46. With reference to FIG. 4, a driven pulley 52 is drivingly connected to the drive pulley 48 by a belt 54. The driven pulley 52 is connected to an input shaft 56 of a planetary gear train that is disposed within the rotatable drum 28. The belt 54 can be tensioned by adjusting the position of the motor mount brackets 32R, 32L relative to the side chassis members 26R, 26L. It should be noted that a chain and sprocket system can be used in place of the belt and pulley system shown.

Figure 5:
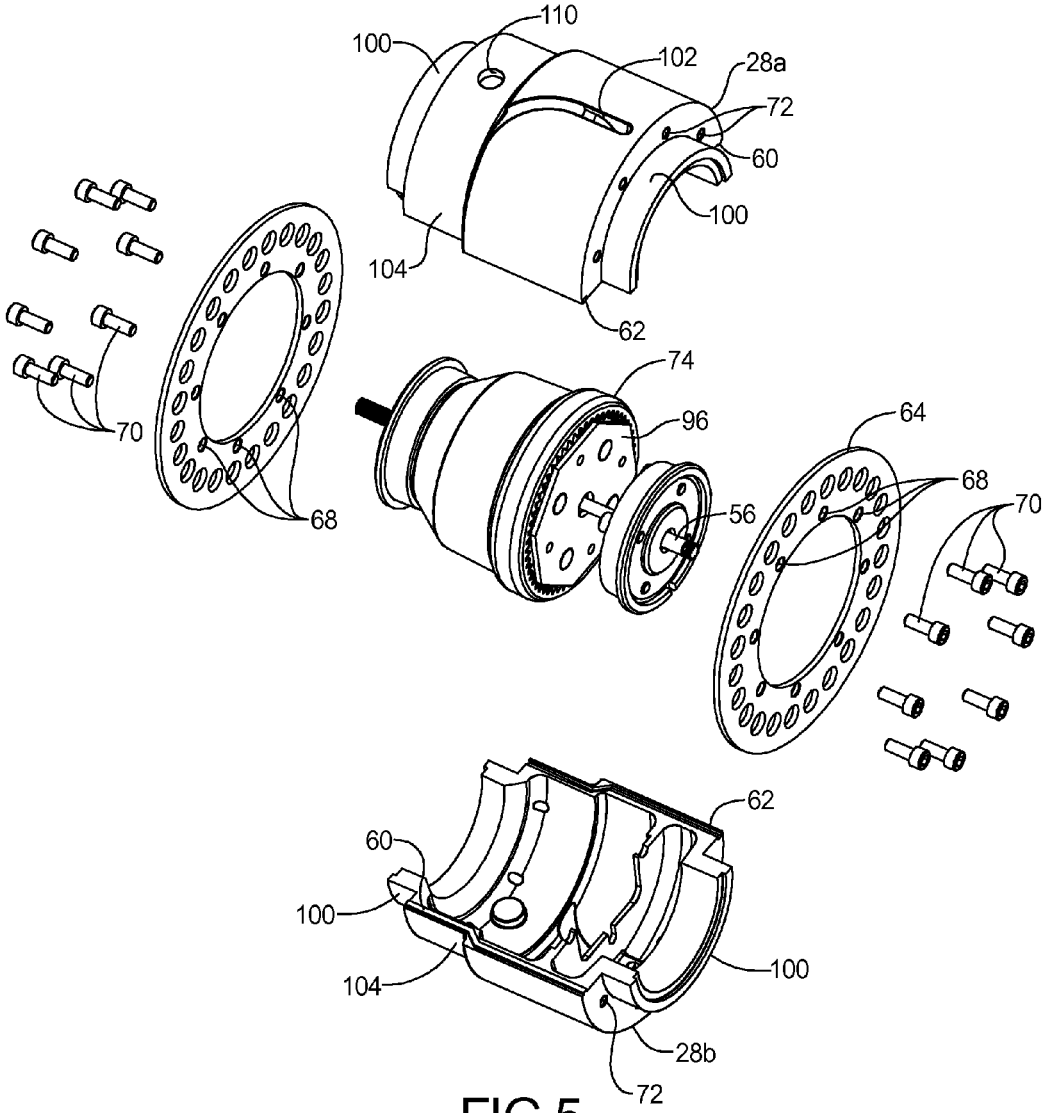
FIG. 5 is a perspective partially exploded view of the drum and planetary gear system of the portable pulling tool for illustration purposes.

With reference to FIG. 5, the assembly of the rotatable drum 28 will now be described. The rotatable drum 28 includes a first drum half 28*a* and a second drum half 28*b*. The drum halves 28*a*, 28*b* can include a protruding mating rib 60 and a recessed groove 62 along opposite edges thereof for mating with a corresponding groove 62 and rib 60 of the other drum half 28*a*, 28*b*. A pair of drum flanges 64, 66 are each provided with a plurality of apertures 68 that receive corresponding threaded fasteners 70 which are threaded into corresponding threaded bores 72 provided in the drum halves 28*a*, 28*b*. The drum flanges 64, 66 secure the drum halves 28*a*, 28*b* together. A planetary gear system 74 is disposed within the drum assembly 28.

Figure 6:
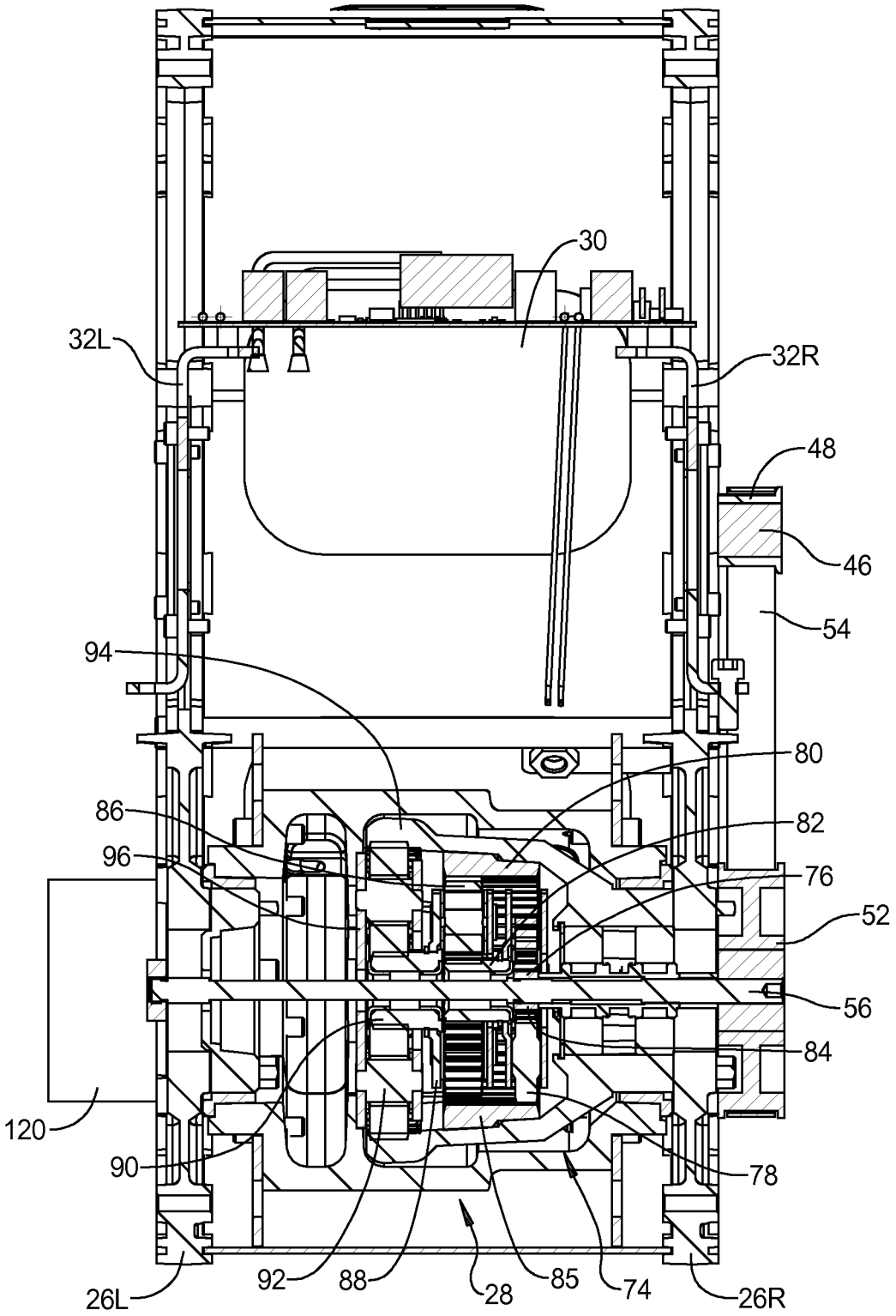
FIG. 6 is a cross-sectional view of the pulling tool illustrating the components of the planetary gear system within the drum according to the principles of the present disclosure.

With reference to FIG. 6, the planetary gear system 74 will now be described. The planetary gear system 74 receives input from the input shaft 56 that is connected to the driven pulley 52. A first stage sun gear 76 is fixed to the input shaft 56 and drives a first stage planetary gear set 78 with each planetary gear 78 engaging a first ring gear 80. The first stage planetary gear set includes a planetary carrier 82 that is connected to a second stage sun gear 84. The second stage sun gear 84 drivingly engages a plurality of second stage planetary gears 86 which are each in meshing engagement with a second stage ring gear 85. The planetary gears 86 of the second stage planetary gear set are rotatably mounted to a second stage planetary carrier 88. The second stage planetary carrier 88 is connected to a third stage sun gear 90. The third stage sun gear 90 is drivingly engaged with a plurality of third stage planetary gears 92 which are in meshing engagement with a third stage ring gear 94. The third stage planetary gears 92 are mounted to a third stage planetary carrier 96 which is connected to the rotatable drum 28 for providing drive torque to the rotatable drum 28.

Figure 7:
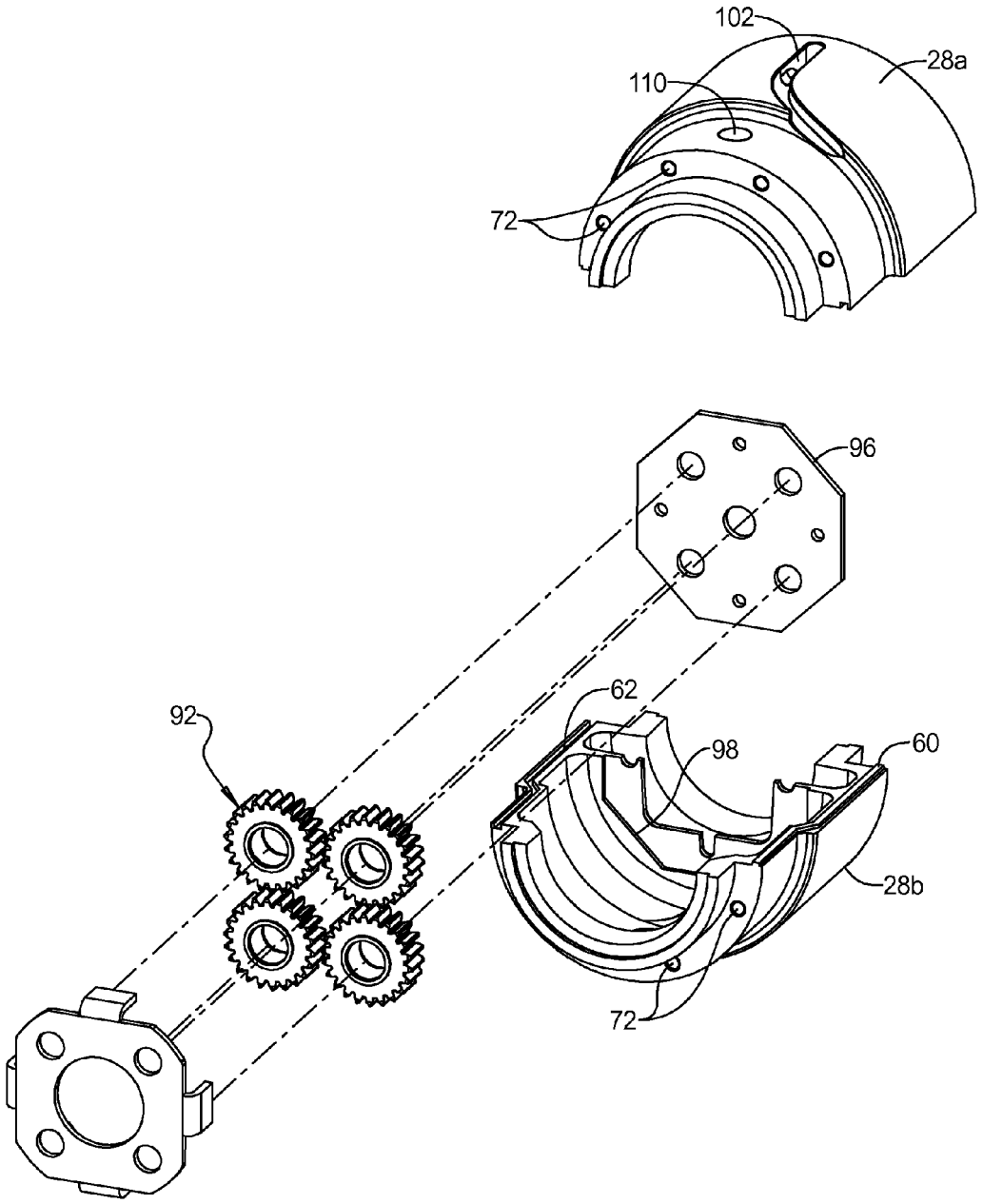
FIG. 7 is an exploded perspective view of the drum and components of the third planetary gear set shown for illustrative purposes.
Figure 8:
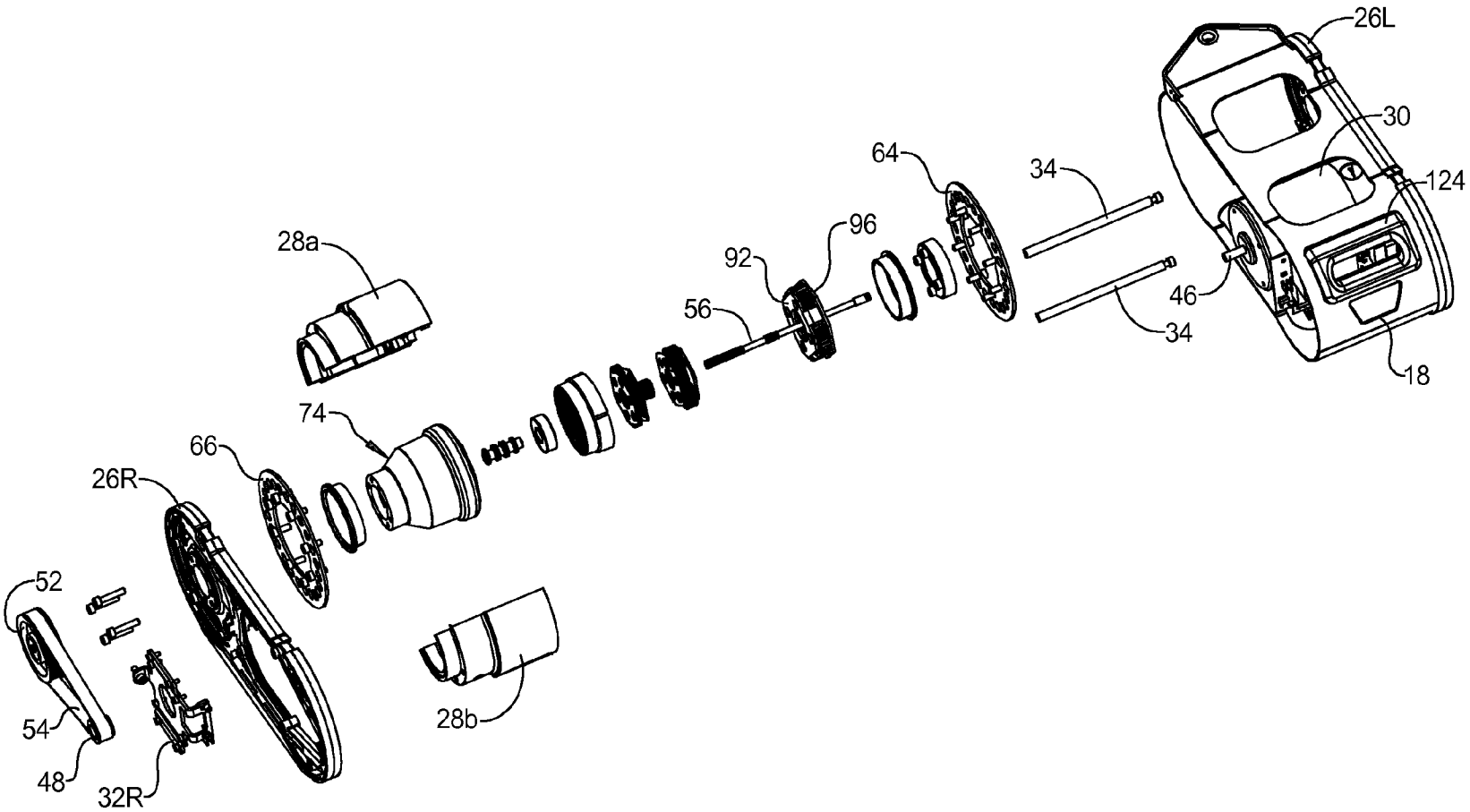
FIG. 8 is an exploded perspective view of a portion of the pulling tool shown in FIG. 1.

With reference to FIGS. 5 and 7, the third stage planetary carrier 96 is shown having an octagonal shape. It should be noted that the octagonal shape of the third stage planetary carrier 96 can have other polygonal shapes such as hexagonal or square. The polygonal shaped third stage planetary carrier 96 is received in a similarly shaped polygonal recess 98 that is defined inside of the rotatable drum 28, as best shown in FIG. 7. The polygonal recess cavity 98 receives the polygonal shaped third stage planetary carrier 96 so as to transfer rotation from the third stage planetary carrier 96 to the rotatable drum 28.

Figure 9:
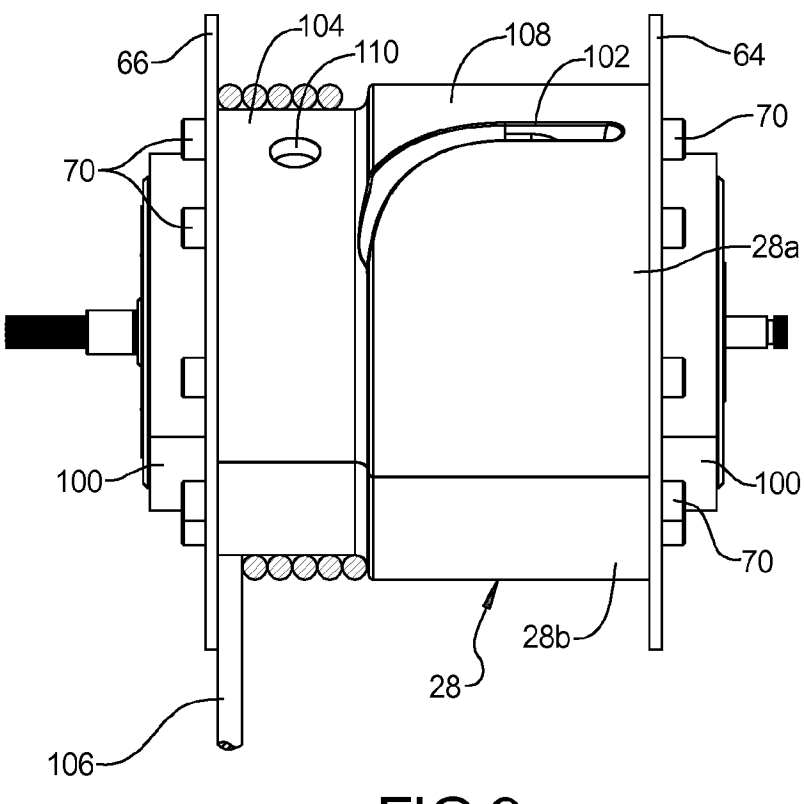
FIG. 9 is a plan view of the drum and cable unit according to the principles of the present disclosure.

As shown in FIG. 5, the drum halves 28*a*, 28*b* each include a cylindrical bearing surface 100 at opposite ends thereof that allow the drum 28 to be rotatably supported at opposite ends thereof within the housing 12. The first drum half 28*a* includes a rope anchor slot 102 in the cylindrical surface defined therein. The rope anchor slot 102 is designed to allow a cable or rope to be anchored to the drum and is provided with a curvature that feeds the cable or rope from the anchor over top of a reduced diameter cylindrical portion 104 of the drum 28. The reduced diameter cylindrical portion 104 of the drum 28 is designed to receive the initial wraps of the rope or cable 106 thereon as best illustrated in FIG. 9. The cable 106 extends from the rope anchor 102 in a stepped shoulder of a relatively larger diameter portion 108 of the drum and provides several wraps around the smaller diameter portion 104. Because a pulling force of the pulling tool 10 depends upon the effective diameter of the drum 28, the initial wraps of the cable 106 around the drum 28 are intended to generally remain on the drum 28 and to be over wrapped by outer layers of rope or cable that effectively have a common minimum diameter equal to or larger than the diameter of the larger diameter portion 108 of the drum.

Figure 10:
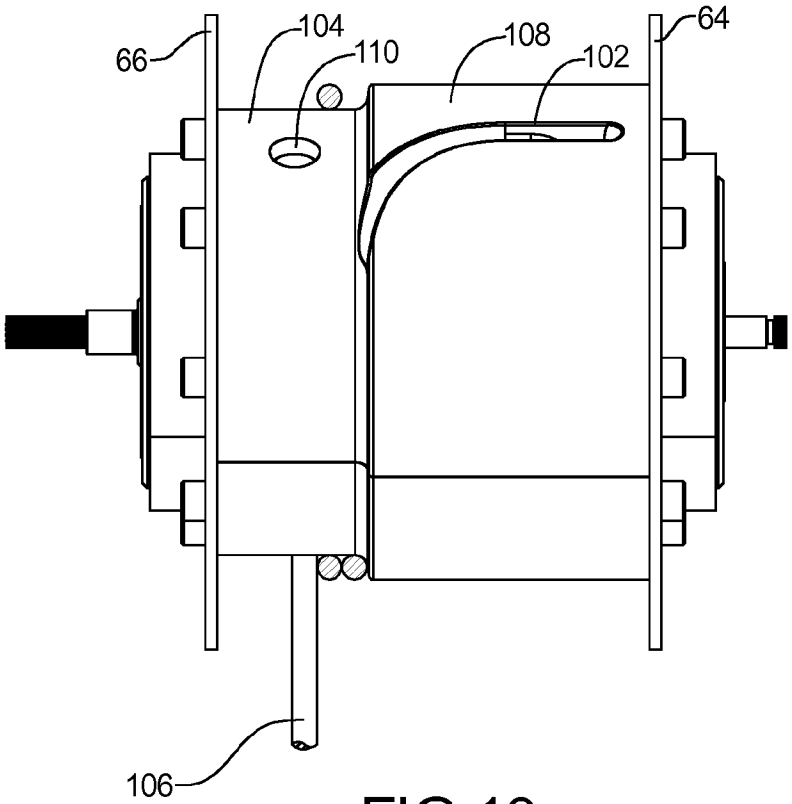
FIG. 10 is a plan view of the drum and cable unit with the cable removed to expose a magnet therein.
Figure 11:
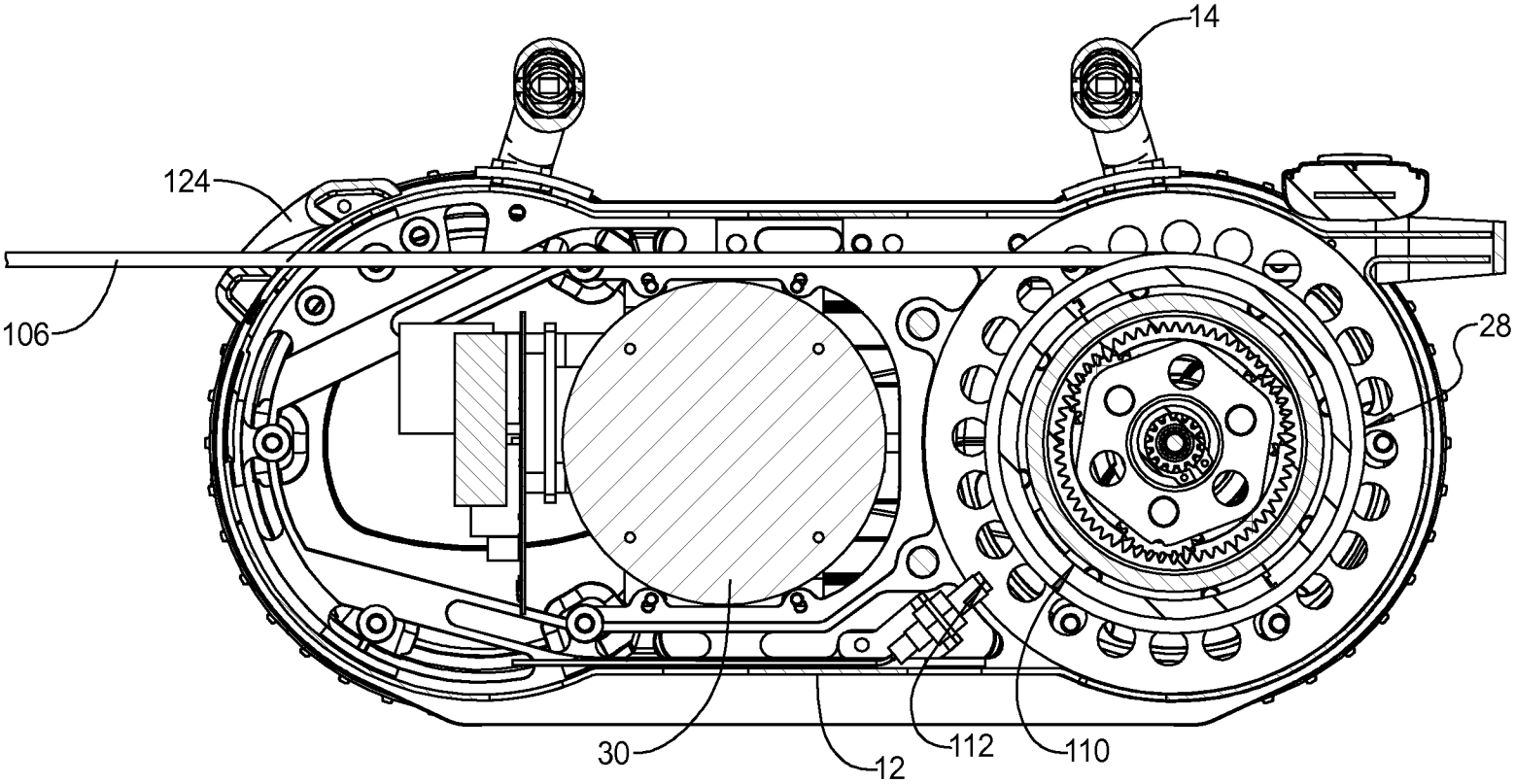
FIG. 11 is a cross-sectional view of the pulling tool according to the principles of the present disclosure.
Figure 16:
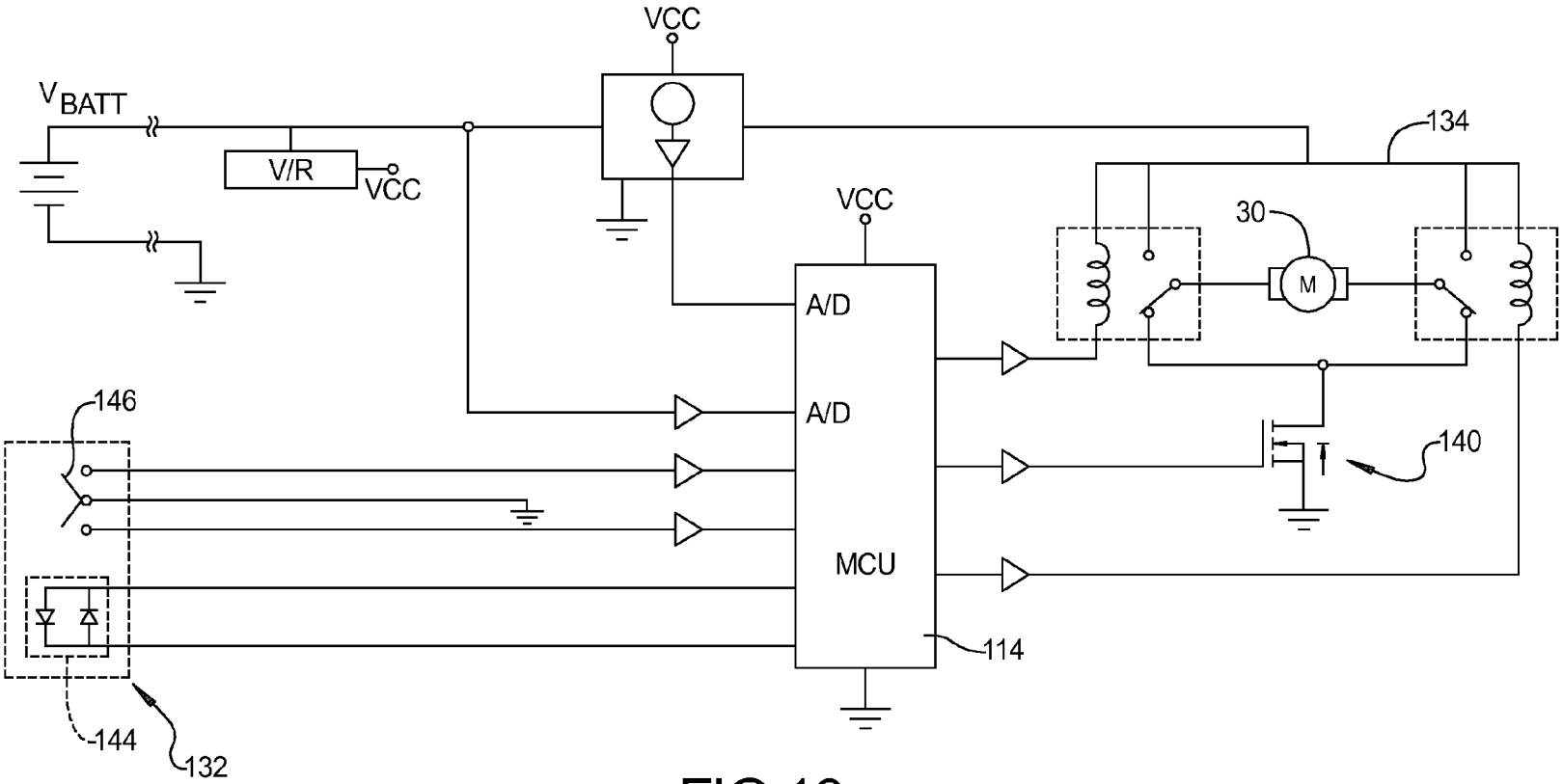
FIG. 16 is a schematic control diagram of the pulling tool incorporating a soft start control according to the principles of the present disclosure.

The rotatable drum 28 can be provided with a magnet 110 that is recessed within the smaller diameter portion 104 of the rotatable drum 28. During operation, the embedded magnet 110 can be covered by the initial wraps of the cable 106 which is wrapped around the small diameter portion 104 of the drum 28 as illustrated in FIG. 9. As the cable 106 is un-wound off of the drum, as illustrated in FIG. 10, the magnet 110 becomes uncovered and the magnetic field of the magnet 110 can be detected by a sensor 112 that is mounted within the housing 12, as illustrated in FIG. 11. As the sensor 112 senses the magnetic field of the uncovered magnet 110, the sensor 112 can provide a signal to a microcontroller unit 114, as illustrated in FIG. 16. In response to the receipt of the signal from the magnetic field sensor 112, the microcontroller unit 114 ceases operation of the motor 30 so that no additional cable is un-wound from the drum 28.

Figure 15:
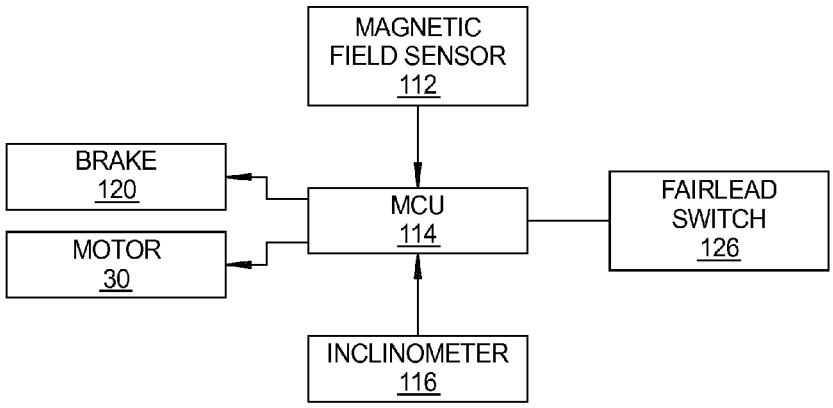
FIG. 15 is a schematic control diagram of the pulling tool according to the principles of the present disclosure.

With continued reference to FIG. 15, an inclinometer 116 can be mounted to the housing 12 in order to detect whether the pulling tool 10 is in a horizontal or vertical orientation. The pulling tool 10 can be utilized as both a hoist for lifting objects in a vertical direction off the ground, or can be utilized as a winching device for pulling objects horizontally. The design and safety requirements of a hoist are different than the design and safety requirements for a winch, and therefore, the inclinometer 116 provides signals to the microcontroller unit 114 to indicate whether the pulling tool 10 is oriented in a vertical position for hoisting or in a horizontal position for pulling. The micro controller unit 114 receives the signal from the inclinometer 116 and based upon the signal can operate the pulling tool in a first hoist mode, or in a second winching mode utilizing the differing hoist or winch parameters for each mode. The inclinometer 116 can be mounted to a printed circuit board or another portion of the pulling tool 10. The inclinometer 116 can be a three-axis low-g micro-machined accelerometer that is used to monitor the position of the portable tool 10. The microcontroller unit 114 can include an algorithm that calculates the pitch and rolling angles of the tool relative to the gravity direction. The microcontroller unit 114 determines the tool's operating conditions and limits the tool capacity based on the particular operating mode. The microcontroller unit 114 can be provided with a threshold angle such as 30 degrees from horizontal for transitioning from a winching mode to a hoisting (lifting) mode. The specific angle can be based upon various design criteria and safety criteria.

Figure 12:
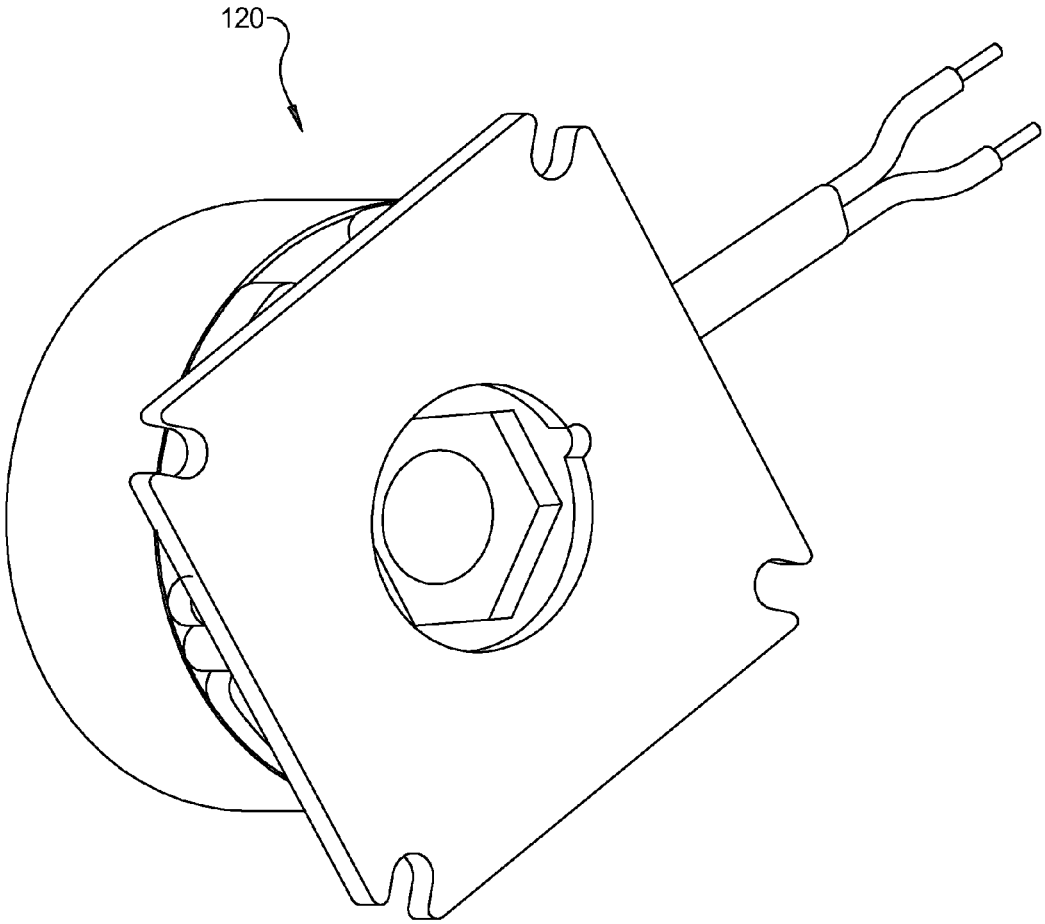
FIG. 12 is a perspective view of an electric brake according to the principles of the present disclosure.

With reference to FIGS. 3 and 12, an electric brake 120 is provided for engaging the input shaft 56 of the planetary gear system 74. The electric brake is mounted to the left side chassis member 26L and is spring biased to be normally engaged to the shaft 56. The electric brake 120 can be electrically actuated to disengage the brake 120 from the input shaft 56 when the motor 30 is operated in the spool in or spool out directions. When the electric current is interrupted to the motor 30, electric current to the brake 120 is also interrupted so that the brake automatically re-engages with the input shaft 56. The connection of the electric brake 120 to the input shaft 56 of the planetary gear system takes advantage of the gear reduction of the three-stage planetary gear system 74 which greatly reduces the amount of braking torque that is required to hold the rotatable drum 28 in a braked condition. Furthermore, the braking occurs at a location that is downstream from the pulley and belt system 48, 52, 54 so that if the belt 54 slips or breaks, the brake 120 holds the drum in a static position.

The control of the pulling tool at startup, can include a soft-start. As illustrated in FIG. 16, the microcontroller unit 114 can be provided with signals from a remote control unit 132 that provides direction signals including "spool in" and "spool out" to the microcontroller unit 114. In response to these signals, the microcontroller unit 114 provides a direction signal to a relay circuit 134 that determines the direction of rotation of the motor 30. In addition, the microcontroller unit 114 provides signals to a power MOSFET driver 140 for supplying current to the motor 30. The soft start method is provided by ramping a pulse width modulated MOSFET driver signal at startup for a short period of time such as for example, 1-2 seconds. By providing the MOSFET driver 140 with a pulse width modulated signal at startup, the motor speed is gradually increased over time, as illustrated in FIG. 18, to provide a soft start that allows the "spooling in" and "spooling out" of the cable 106 to be operated with precision. Furthermore, the soft start increases the tool's durability by reducing shocks and impulse loading impacts on the tool 10. The method of the present disclosure eliminates the need for using high cost variable triggering switches and is compatible with remotes 132 (FIG. 14) with a toggle switch 146. In addition, the soft start system of the present disclosure is compatible with commonly used wireless controls.

Figure 17:
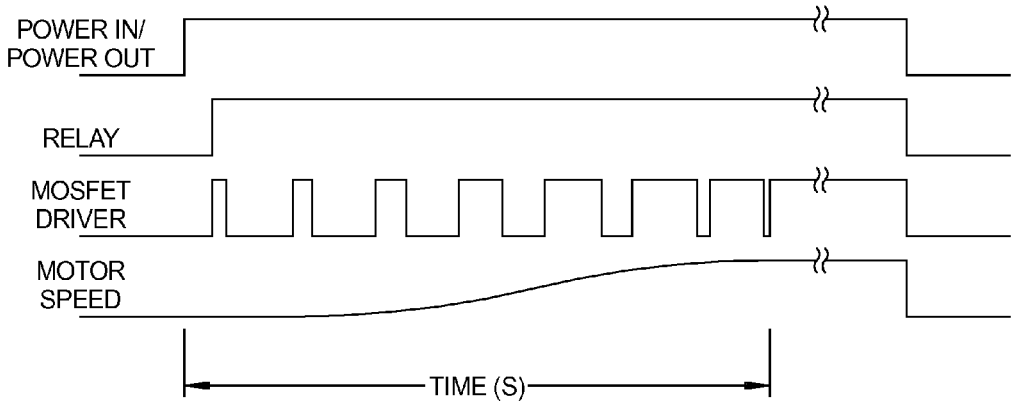
FIG. 17 is a graphical illustration of the input of the power in/power out switch, thereby, the MOSFET driver and the motor speed over time according to the soft start control according to the principles of the present disclosure.

FIG. 17 provides a graphical illustration of the input of the power in/out switch, the relay, the MOSFET driver, and the motor speed over time during a soft start operation according to the principles of the present disclosure.

The wired remote control 132 can be operated at a low-voltage (12V DC) and provide safe operation and an extended cable length without power loss. The remote control 132 provides the user with an emergency stop switch 142 and LED feedback 144. The low-voltage emergency stop switch 142 is incorporated into the remote control 132 to provide the user the ability to shut off the power to the system. Power to the motor remains off until the power cord 16 is disconnected and the emergency stop switch button 142 is reset.

Figure 13:
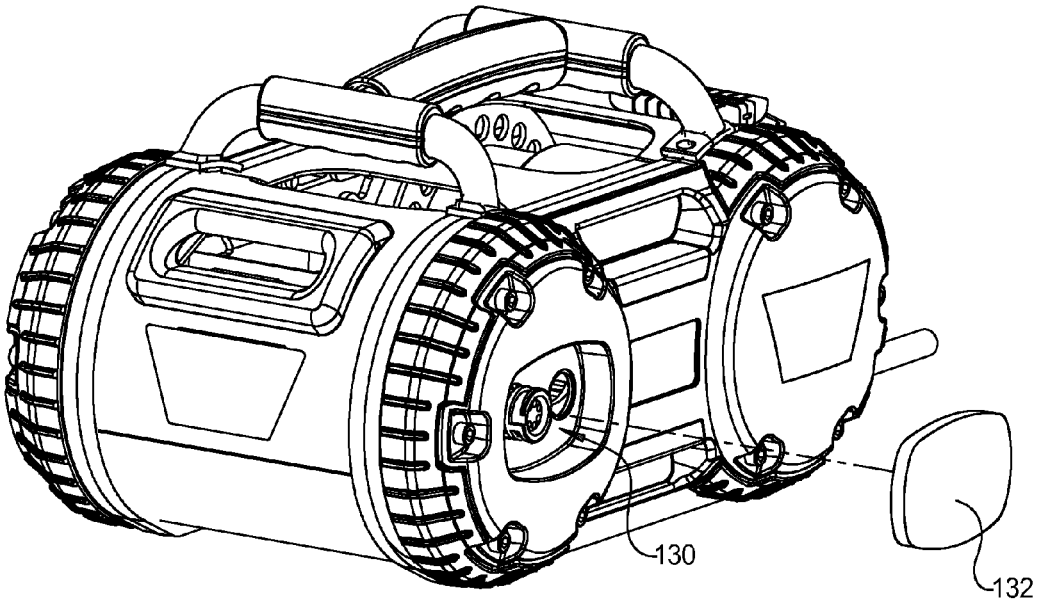
FIG. 13 is a perspective view of the pulling tool having a remote control accessory incorporated into the housing according to the principles of the present disclosure.
Figure 14:
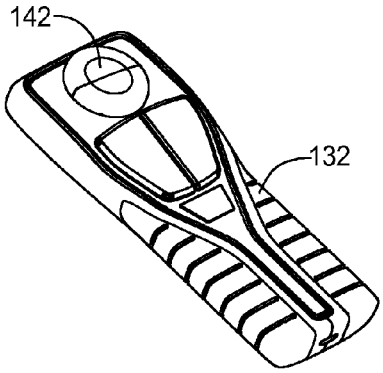
FIG. 14 is a perspective view of a remote control unit according to the principles of the present disclosure.

With reference to FIG. 13, the portable pulling tool 10 can include a recessed cavity 130 in a surface thereof for receiving an accessory or multiple accessories for the pulling tool. The accessory can include a remote control unit 132, as illustrated in FIG. 14, or can include accessories such as additional hooks, snatch blocks, and other rope or cable accessories.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A portable pulling tool, comprising:

a housing having a first end having a cable opening therein formed in an outer surface of the housing;

a handle mounted directly to the outer surface of the housing, at two or more mounting locations, where the portable pulling tool is hand held;

a rotatable drum disposed within said housing and having a cable wound thereon, said cable extending through said cable opening in said first end of said housing, the rotatable drum including a cylindrical region disposed between a pair of drum flanges, where the cable is wound around the cylindrical region;

a motor disposed in said housing and drivingly connected to said rotatable drum, where the handle extends from a position above the drum to a position above the motor, in a direction perpendicular to a rotational axis of the drum; and a planetary gear train drivingly connected between said motor and said drum, said planetary gear train disposed within an interior of the cylindrical region of said rotatable drum, where the housing encloses the drum, motor, and planetary gear train from above and below.

2. The portable pulling tool according to claim 1, wherein said motor includes a drive shaft having a drive pulley connected thereto and said planetary gear train includes an input member having a driven pulley connected thereto, said driven pulley being drivingly connected to said drive pulley by a belt.

3. The portable pulling tool according to claim 1, wherein the housing includes a center shell, the center shell defining a cavity therein and a pair of side openings, and first and second side covers covering the pair of side openings, wherein the drum, motor, and planetary gear train are all disposed inside the cavity, between the first and second side covers, where a top of the center shell is positioned above the drum, motor, and planetary gear train and a bottom of the center shell is positioned below the drum, motor, and planetary gear train.

4. The portable pulling tool according to claim 3, wherein said motor includes a drive shaft having a drive pulley connected thereto, and further comprising a pair of chassis members disposed in said housing for rotatably supporting said drum, the pair of chassis members disposed on opposite sides of the center shell, each of the chassis members of the pair of chassis members disposed in a respective side opening of the pair of side openings, and wherein said pair of chassis members each includes an opening therein for receiving a motor mount bracket for supporting said motor, where the motor mount bracket has an opening therein for receiving the drive shaft and where the drive shaft of the motor and the drive pulley are disposed on an outboard side of the motor mount bracket of one of the pair of chassis members.

5. The portable pulling tool according to claim 1, wherein the cylindrical region includes an outer cylindrical surface, where the cable is wound around the outer cylindrical surface, between the pair of drum flanges.

6. The portable pulling tool according to claim 5, wherein said handle is directly connected to the outer surface of said housing at at least three spaced locations.

7. The portable pulling tool according to claim 1, wherein a planetary carrier of the planetary gear train includes a polygonal shape that is received in a corresponding polygonal shaped recess in the interior of the cylindrical region of the rotatable drum so that the planetary carrier provides drive torque to said rotatable drum, where the planetary carrier has a polygonal cross-section defined about a rotational axis of the planetary gear train.

8. A portable pulling tool, comprising:

a housing including a center shell defining a first cavity therein and a pair of side openings on opposite ends of the center shell, the housing further including first and second side covers covering the pair of side openings, the center shell having a first end having a cable opening therein;

a handle mounted directly to the housing at two or more mounting locations, where the portable pulling tool is hand held;

a rotatable drum disposed in said housing, between the first and second side covers, and having a cable wound thereon, said cable extending through said cable opening in said first end of said housing;

a motor disposed in said housing, between the first and second side covers, outside of the drum, and drivingly connected to said rotatable drum; and wherein said housing includes at least one second cavity for receiving an accessory for said portable pulling tool.

9. The portable pulling tool according to claim 8, wherein said accessory is a hand held remote control unit, wherein the second cavity is recessed into an outer surface of one of the first and second side covers, and wherein the center shell of the housing encloses the drum and motor from above and below.

10. A pulling tool, comprising:

a housing;

a rotatable drum disposed in said housing and having a cable wound around an outer cylindrical surface of the rotatable drum, where the outer cylindrical surface of the rotatable drum is positioned between a central rotational axis of the rotatable drum and windings of the cable, said rotatable drum including a magnet disposed in the outer cylindrical surface of the drum and said housing including a magnetic field sensor for sensing when the cable is not wound onto the drum in an area of said magnet;

a motor disposed in said housing and drivingly connected to said rotatable drum;

a handle connected to the housing and extending from a position above the drum to a position above the motor, in a direction perpendicular to the central rotational axis of the drum; and a controller for controlling operation of the motor and for receiving a signal from the magnetic field sensor and for deactivating the motor when the magnetic field sensor senses the magnet in the drum when the cable is unwound from the drum to expose the magnetic field of the magnet to the magnetic field sensor.

11. The pulling tool of claim 10, wherein the outer cylindrical surface is a surface of a cylindrical region of the drum and the magnet is embedded in the outer cylindrical surface, wherein the magnetic field sensor senses the magnet when the cable is unwound off of the outer cylindrical surface of the cylindrical region of the drum, and wherein the pulling tool is hand-held via the handle.

12. The pulling tool of claim 10, wherein the outer cylindrical surface is a surface of a cylindrical region of the drum and further comprising a planetary gear train drivingly connected between said motor and said drum, said planetary gear train disposed within an interior of the cylindrical region of the drum, and where the housing encloses the drum, motor, and planetary gear train from above and below.

13. The pulling tool of claim 10, wherein the housing has a first end having a cable opening formed in an outer surface of the housing and wherein the motor is disposed between the cable opening and the drum within the housing.

14. A pulling tool, comprising:

a housing;

a rotatable drum disposed in said housing and having a cable wound thereon, said rotatable drum having a first cylindrical region having a first diameter and a second cylindrical region having a second diameter larger than the first diameter, the first cylindrical region receiving initial wraps of the cable thereon, the second cylindrical region including a rope anchor slot recessed into a cylindrical surface of the second cylindrical region, where the rope anchor slot extends in two different directions, a first portion of the rope anchor slot extending in a first direction along a stepped shoulder in the second cylindrical region, at an interface between the first cylindrical region and the second cylindrical region, and a second portion of the rope anchor slot extending in a second direction, parallel to a rotational axis of the drum, where the rope anchor slot includes a curved transition between the first portion and the second portion, where the second portion extends along a length of the second cylindrical region of the cylindrical surface in the second direction, and where the length of the second cylindrical region is longer than a length of the first cylindrical region; and a motor disposed in said housing and drivingly connected to said rotatable drum.

15. The pulling tool according to claim 14, wherein said rotatable drum is made from a first drum half and a second drum half that each define half of the first cylindrical region and half of the second cylindrical region and wherein the puling tool is portable and hand held and includes a handle connected to the housing.

16. The pulling tool according to claim 15, further comprising a pair of drum flanges that secure said first drum half to said second drum half.

17. The pulling tool according to claim 14, further comprising a planetary gear train drivingly connected between said motor and said drum, said planetary gear train disposed in said rotatable drum and wherein the housing includes a center shell defining a cavity therein and a pair of side openings on opposite ends of the center shell, the housing further including first and second side covers covering the pair of side openings, and wherein the drum and the motor are disposed within the cavity, between the first and second side covers.

18. A pulling tool, comprising:

a housing including a center shell and two side covers covering side openings of the center shell;

a rotatable drum disposed in said housing, between the two side covers, and having a cable wound thereon;

a motor disposed within the center shell of said housing, between the two side covers, and outside of the rotatable drum, and drivingly connected to said rotatable drum, where an outer cylindrical surface of the rotatable drum is positioned between a drive shaft of the motor and a rotational axis of the rotatable drum;

a planetary gear train drivingly connected between said motor and said drum and disposed inside the rotatable drum; and an electric brake fixed within said housing, between the two side covers, and engaging an input member of said planetary gear train, the electric brake coupled to the input member outside of the drum.

19. The pulling tool according to claim 18, wherein said electric brake has a normally engaged condition and is electrically actuated to disengage said electric brake and wherein the center shell defines a cable opening at a first end of the center shell and wherein the motor is disposed between the cable opening and the drum.

20. The pulling tool according to claim 18, further comprising a pair of chassis members disposed in said housing, on opposite sides of the center shell, for rotatably supporting said drum, where the drum and motor are disposed between the pair of chassis members, said electric brake being mounted to one of said pair of chassis members and wherein the drive shaft is parallel to the rotational axis of the rotatable drum.

21. A portable pulling tool, comprising:

a housing;

a handle connected to the housing for picking up the portable pulling tool, where the portable pulling tool is hand held;

a rotatable drum disposed in said housing and having a cable wound thereon;

a motor disposed in said housing and drivingly connected to said rotatable drum;

an inclinometer mounted to the housing and configured to detect an orientation of the portable pulling tool; and a microcontroller for controlling operation of the motor and for receiving a signal from the inclinometer and for controlling operation of the portable pulling tool in a first pulling mode when the inclinometer detects that the portable pulling tool is horizontally oriented and for controlling operation of the portable pulling tool in a second pulling mode different than the first pulling mode when the inclinometer detects that the portable pulling tool is vertically oriented, where the first pulling mode is a winching mode for pulling a load horizontally and the second pulling mode is a hoisting pulling mode for lifting a load vertically.

22. A portable pulling tool, comprising:

a housing;

a handle directly connected to the housing at at least three spaced locations on the housing for picking up the portable pulling tool, where the portable pulling tool is hand held;

a rotatable drum disposed within said housing and having a cable wound thereon;

a motor disposed within said housing and drivingly connected to said rotatable drum; and a controller for controlling operation of the motor and for receiving a power in and a power out signal from a hand held remote control unit and for controlling operation of the portable pulling tool with a soft start control, in response to one of the received power in and power out signals, wherein a pulse width modulated current input is provided to the motor to gradually increase a motor speed at start-up for a period of time, where a width of the pulse width modulated current input is increased over the period of time, and after the period of time, the current input to the motor is constant.

23. The portable pulling tool of claim 22, wherein the housing includes a center shell, the center shell defining a cavity therein and two side openings, and two side covers, each side cover covering one of the two side openings, and wherein the motor and the drum are disposed within the cavity of the housing, between the two side covers.

* * * * *